US008944530B2

(12) United States Patent
Haft et al.

(10) Patent No.: US 8,944,530 B2
(45) Date of Patent: Feb. 3, 2015

(54) DOOR BALANCING SYSTEM FOR AN APPLIANCE

(71) Applicant: Wolf Appliance, Inc., Fitchburg, WI (US)

(72) Inventors: Thomas Haft, Madison, WI (US); Colin R. Clerkin, Waunakee, WI (US); Gerry Lippincott, Milton, WI (US)

(73) Assignee: Wolf Appliance, Inc., Fitchburg, WI (US)

( * ) Notice: Subject to any disclaimer, the term of this patent is extended or adjusted under 35 U.S.C. 154(b) by 44 days.

(21) Appl. No.: 13/925,057

(22) Filed: Jun. 24, 2013

(65) Prior Publication Data

US 2014/0375192 A1 Dec. 25, 2014

(51) Int. Cl.
*A47B 77/06* (2006.01)
*E05F 3/18* (2006.01)
*A47B 96/00* (2006.01)

(52) U.S. Cl.
CPC .. *E05F 3/18* (2013.01); *A47B 96/00* (2013.01)
USPC ..... 312/228; 312/319.2

(58) Field of Classification Search
CPC .... A47L 15/4261; E05D 13/1207; E05F 3/18
USPC ..... 312/319.1–319.4, 228, 326–328, 311; 16/72, 78, 81, 286, 289, 306, 197, 193; 49/386, 387; 126/191; 134/56 D, 57 D
See application file for complete search history.

(56) References Cited

U.S. PATENT DOCUMENTS 2,045,060 A 6/1936 Wheatley
3,046,974 A * 7/1962 Kimberley ..... 126/191
3,049,114 A * 8/1962 Carnahan et al. ..... 126/191
4,076,351 A * 2/1978 Wyant ..... 312/247
5,980,006 A * 11/1999 Wilhelmstatter et al. .. 312/319.1
5,988,933 A 11/1999 Wilhelmstätter et al.
6,412,144 B1 * 7/2002 Braid et al. ..... 16/197
6,467,128 B1 * 10/2002 Damani ..... 16/197
7,699,064 B2 4/2010 Schlief et al.
7,862,132 B2 * 1/2011 Tynes et al. ..... 312/328
7,934,783 B2 5/2011 Van Vooren et al.
8,042,891 B2 * 10/2011 Tynes et al. ..... 312/328
8,043,442 B2 * 10/2011 Haeberle ..... 134/56 D
8,292,381 B2 10/2012 McDaniel et al.
8,297,768 B2 10/2012 Kara et al.
8,393,691 B2 3/2013 Diebold et al.
2004/0113531 A1 6/2004 Raches
2009/0072686 A1 * 3/2009 Vooren et al. ..... 312/319.4
2011/0062840 A1 * 3/2011 Tynes et al. ..... 312/228

(Continued)

*Primary Examiner* — Darnell Jayne
*Assistant Examiner* — Hiwot Tefera
(74) *Attorney, Agent, or Firm* — Bell & Manning, LLC

(57) ABSTRACT

A door balancing system includes an adjustment block, a single adjustment screw, a first pulley system, and a second pulley system. The adjustment block includes a threaded orifice and mounts within a bearing housing that includes a bearing surface. The single adjustment screw threads into the threaded orifice and abuts the bearing surface. The first pulley system includes a first pulley, a first cable, and a first spring. The second pulley system includes a second pulley, a second cable, and a second spring. The first cable mounts between a first hinge and the adjustment block using the first pulley and the first spring. The second cable mounts between a second hinge and the adjustment block using the second pulley and the second spring. The first spring and the second spring exert a force on the door to control a rate of movement of the door relative to the body.

20 Claims, 17 Drawing Sheets

(56) References Cited

U.S. PATENT DOCUMENTS

2011/0074261 A1* 3/2011 Assmann et al. ..... 312/326
2011/0215691 A1 9/2011 Keskin et al.
2011/0241507 A1* 10/2011 Diebold et al. ..... 312/228
2012/0111366 A1* 5/2012 Baldwin et al. ..... 134/18
2013/0063011 A1* 3/2013 Kozinski et al. ..... 312/319.2

* cited by examiner

DOOR BALANCING SYSTEM FOR AN APPLIANCE

BACKGROUND

Various appliances have doors that are hinged near a bottom edge, for example, to allow the withdrawal of shelves or baskets on which items are placed or to allow the insertion and removal of items from a cavity of the appliance. Example appliances include dishwashers, ovens, microwaves, washers, dryers, refrigerators, etc. Typically, a user pulls on a top of the door to open it. The doors may have different weights depending, for example, on whether or not a decorative panel is positioned over the exterior of the door, on whether or not detergent is placed in a detergent container in the door, whether or not items are pressing against the door, etc. The center of gravity as well as the weight of the doors further may vary from model to model.

The force that balances the door varies as the door opens due to the effect of gravity and the varying torque that is applied to the door as the door swings open from a vertical position to a horizontal position. Counterbalancing springs are often included to oppose the door opening force or to assist in holding the door closed or in reclosing the door. For example, the counterbalancing springs may oppose the rapid movement that may otherwise occur as the door approaches the fully open position. The counterbalancing springs are located on each side of the door and are connected by a cable between the body of the appliance and the door hinge. An adjustment screw that contacts a bearing surface may be included on each side of the door to separately adjust the spring tension of each spring to control the door opening/closing.

SUMMARY

In an example embodiment, a door balancing system for an appliance is provided. The door balancing system may include, but is not limited to, an adjustment block, a single adjustment screw, a first pulley system, and a second pulley system. The adjustment block is configured to mount within a bearing housing. The bearing housing may include, but is not limited to, a bearing surface mounted to a body of an appliance. The adjustment block may include, but is not limited to, a threaded orifice. The single adjustment screw is configured for threading into the threaded orifice and is configured to abut the bearing surface. The first pulley system may include, but is not limited to, a first pulley, a first cable, and a first spring. The first cable is configured to mount between a first hinge and the adjustment block using the first pulley and the first spring. The first hinge is configured to mount a door to the body on a first side of the door. The first pulley is configured to mount to the body. The second pulley system may include, but is not limited to, a second pulley, a second cable, and a second spring. The second cable is configured to mount between a second hinge and the adjustment block using the second pulley and the second spring. The second hinge is configured to mount the door to the body on a second side of the door. The second pulley is configured to mount to the body. The first spring and the second spring are configured to exert a force on the door to control a rate of movement of the door relative to the body.

In another example embodiment, an appliance is provided. The appliance may include, but is not limited to, a body, a bearing housing, a door, a first hinge, a second hinge, and a door balancing system. The bearing housing may include, but is not limited to, a bearing surface mounted to the body. The first hinge pivotally mounts the door to the body on a first side of the door proximate a lower edge of the door. The second hinge pivotally mounts the door to the body on a second side of the door proximate the lower edge of the door. The door balancing system may include, but is not limited to, an adjustment block, a single adjustment screw, a first pulley system, and a second pulley system. The adjustment block is mounted within the bearing housing and may include, but is not limited to, a threaded orifice. The single adjustment screw is inserted into the threaded orifice to abut the bearing surface. The first pulley system may include, but is not limited to, a first pulley, a first cable, and a first spring. The first pulley is mounted to the body. The first cable is configured to mount between the first hinge and the adjustment block using the first pulley and the first spring. The second pulley system may include, but is not limited to, a second pulley, a second cable, and a second spring. The second pulley is mounted to the body. The second cable is configured to mount between the second hinge and the adjustment block using the second pulley and the second spring. The first spring and the second spring are configured to exert a force on the door to control a rate of movement of the door relative to the body.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
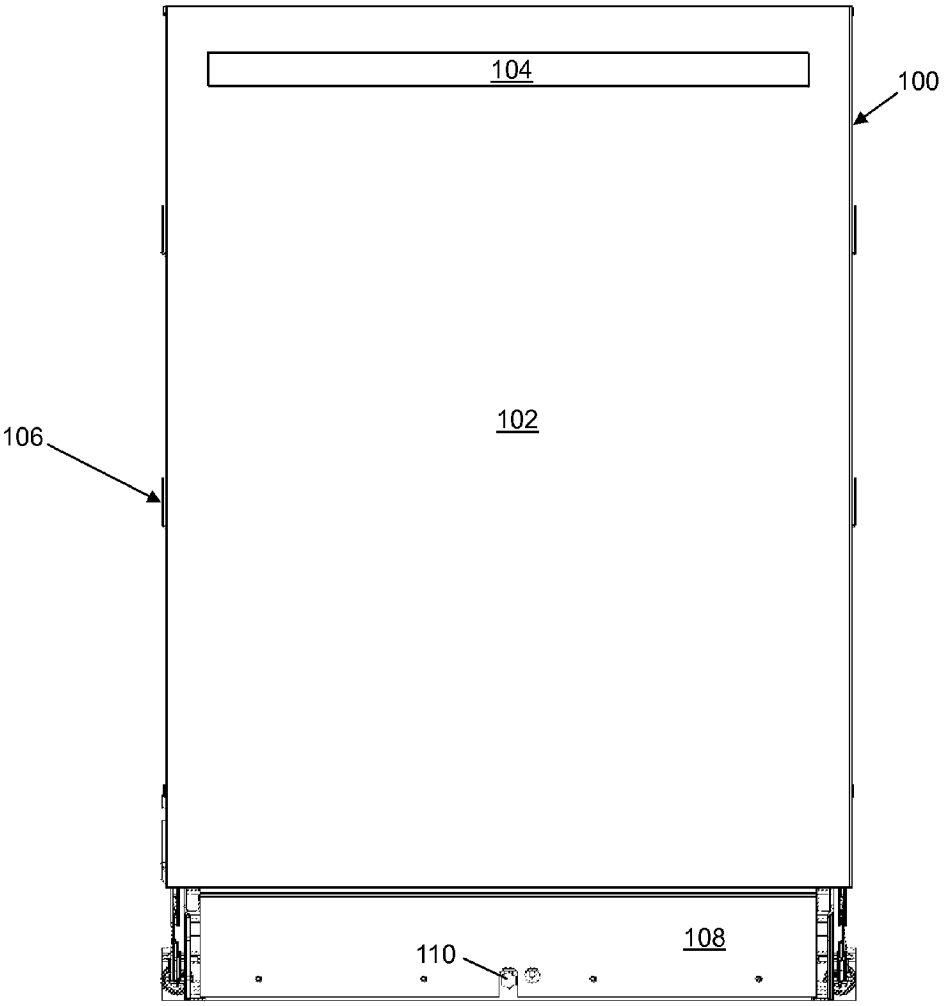
FIG. 1 depicts a front view of an appliance in accordance with an illustrative embodiment.
Figure 2:
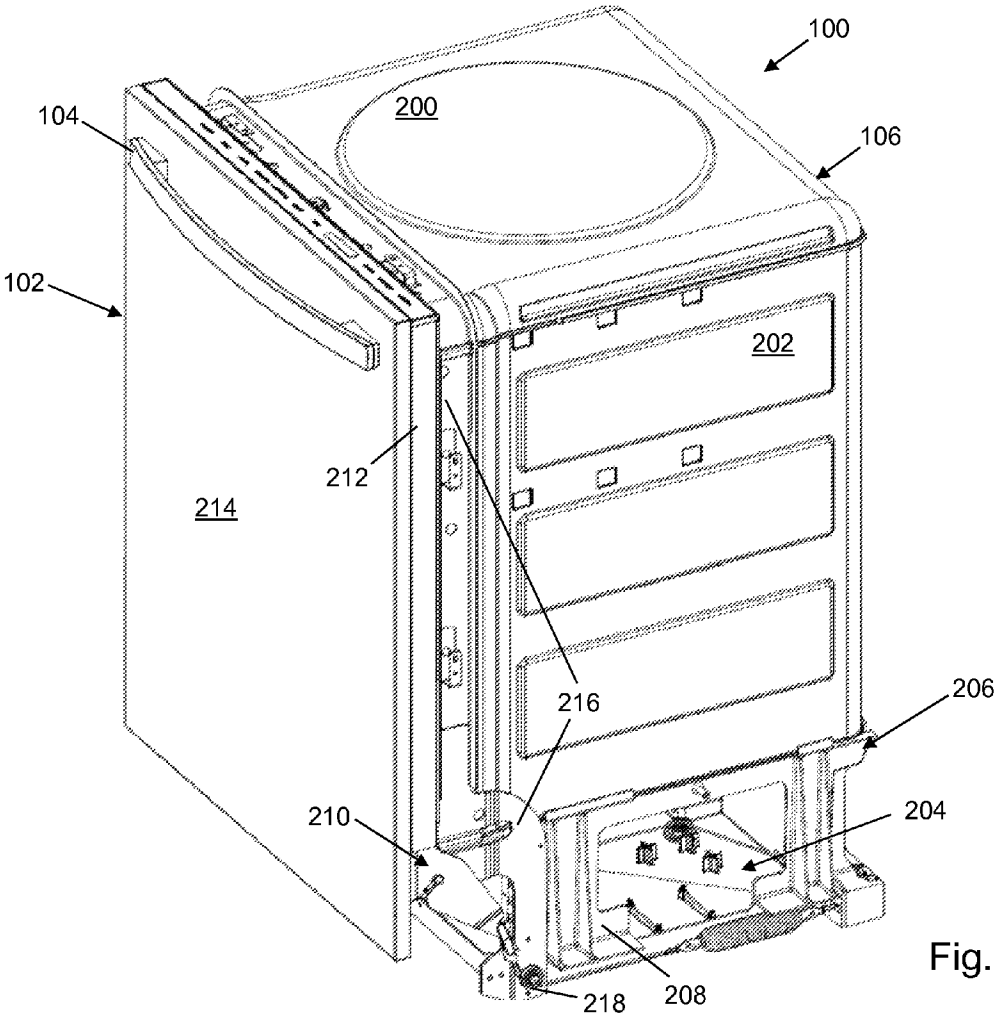
FIG. 2 depicts a front, right side perspective view of the appliance of FIG. 1 in accordance with an illustrative embodiment.

With reference to FIG. 1, an appliance 100 is shown in accordance with an illustrative embodiment. With reference to the illustrative embodiment of FIG. 1, appliance 100 is a dishwasher. In alternative embodiments, appliance 100 may include an oven, a microwave, a washer, a dryer, a refrigerator, or any other appliance that includes a door mounted on an appliance body using a plurality of bottom-mounted hinges.

With reference to FIGS. 1, 2, 3*a*, and 4*a*, appliance 100 may include a door 102, a handle 104, and a body 106. Handle 104 may be mounted to door 102 near a top of door 102 to facilitate opening of door 102, which rotates from a vertical position, as shown in FIG. 1, to a horizontal position (not shown) as understood by a person of skill in the art.

Use of directional terms, such as top, bottom, right, left, front, back, etc. are merely intended to facilitate reference to the various surfaces of the described structures relative to the orientations shown in the drawings and are not intended to be limiting in any manner.

As used herein, the term "mount" includes join, unite, connect, couple, associate, insert, hang, hold, affix, attach, fasten, bind, paste, secure, bolt, screw, rivet, solder, weld, glue, form over, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements. The elements may be mounted permanently, removably, or releasably.

Appliance 100 may include a greater or a fewer number of components. The one or more components of appliance 100 may be formed of one or more materials, such as various metals, glass, and/or plastics having a sufficient strength and rigidity to support the described application.

In the illustrative embodiment, body 106 includes a plurality of walls that, in combination with door 102, form an enclosed space. The enclosed space may include additional items depending on the type of appliance of appliance 100. For example, in the case of a dishwasher type of appliance, the enclosed space may include a tub, a plurality of baskets on which dishes/silverware are placed, plumbing components, one or more spray arms, etc. In the case of a washer type of appliance, the enclosed space may include an agitator, plumbing components, a rotating tub, etc. In the case of a dryer type of appliance, the enclosed space may include an agitator, heating elements, a rotating drum, etc. In the case of a refrigerator type of appliance, the enclosed space may include a plurality of baskets or shelves on which food items are placed, ice making components, cooling components, plumbing components, etc. In the case of an oven type of appliance, the enclosed space may include a plurality of shelves, heating elements, etc.

As understood by a person of skill in the art, the walls that form appliance 100 may include insulation to assist in maintenance of the desired temperature in the enclosed space and/or to suppress noise created by appliance 100. Electrical wiring, electrical circuit boards, various conduits, etc. may further be located in the walls of appliance 100 without limitation.

Figure 4A:
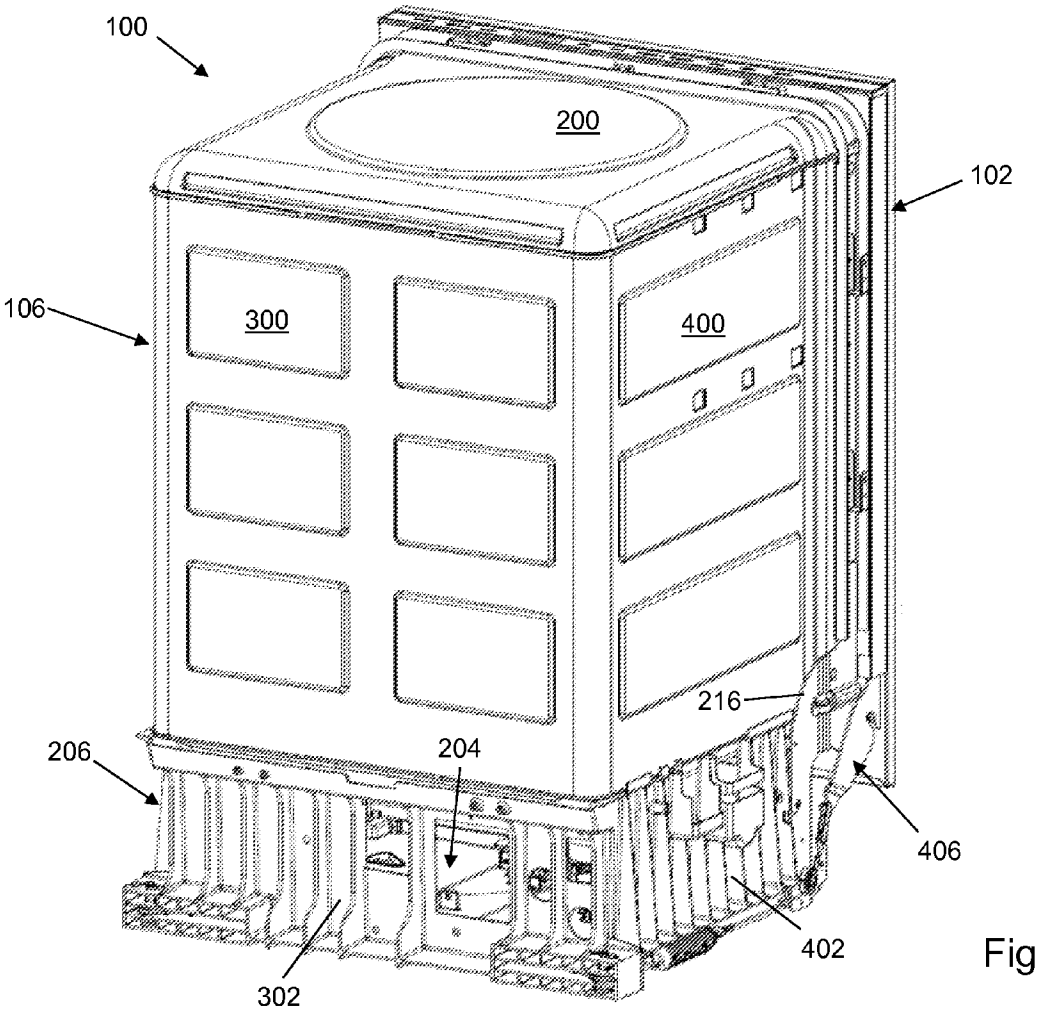
FIG. 4*a* depicts a back, left side perspective view of the appliance of FIG. 1 in accordance with an illustrative embodiment.
Figure 4B:
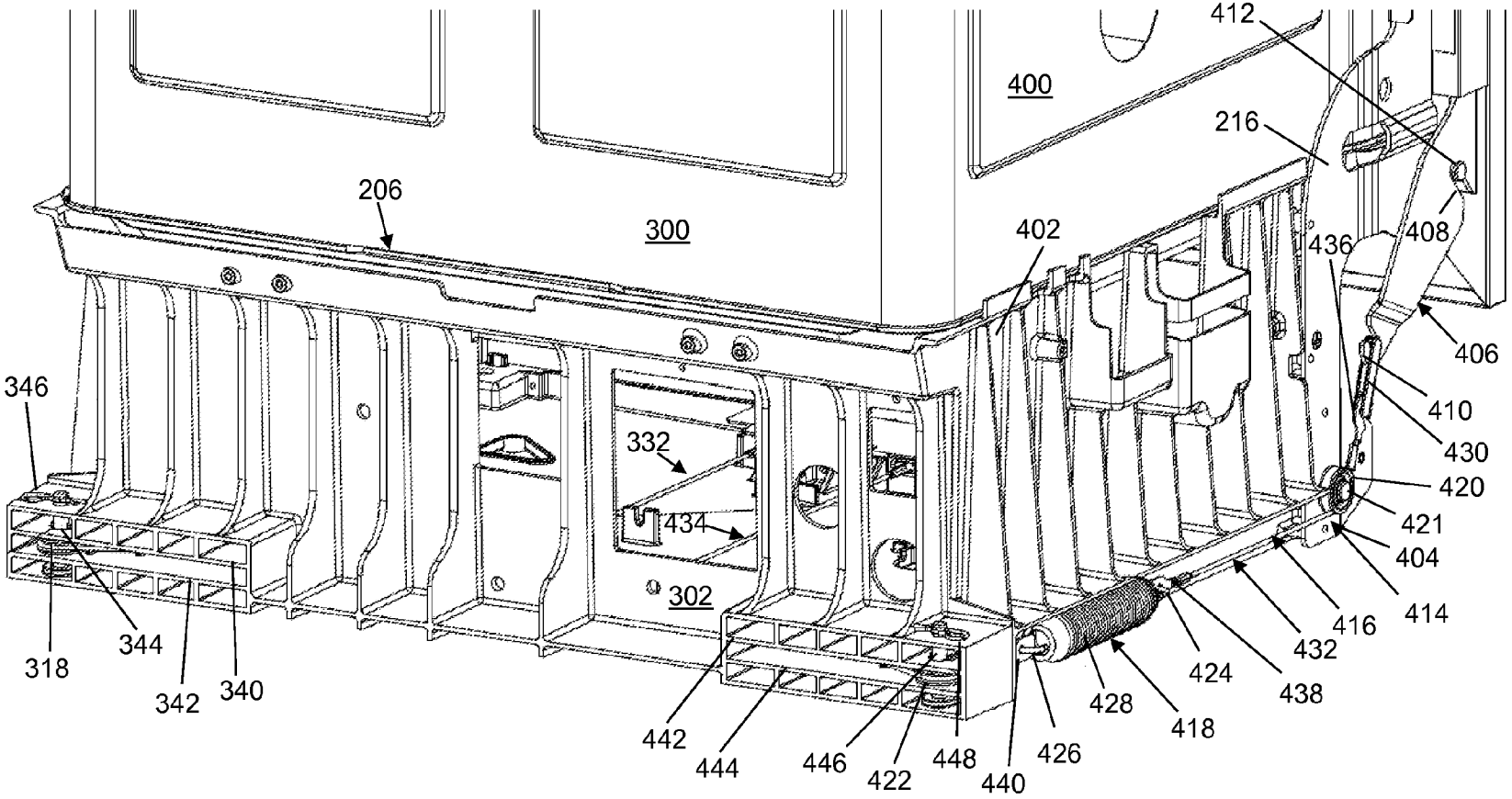
FIG. 4*b* depicts the back, left side perspective view of FIG. 4*a* zoomed to show the base portion of the appliance of FIG. 1 in accordance with an illustrative embodiment.
Figure 5:
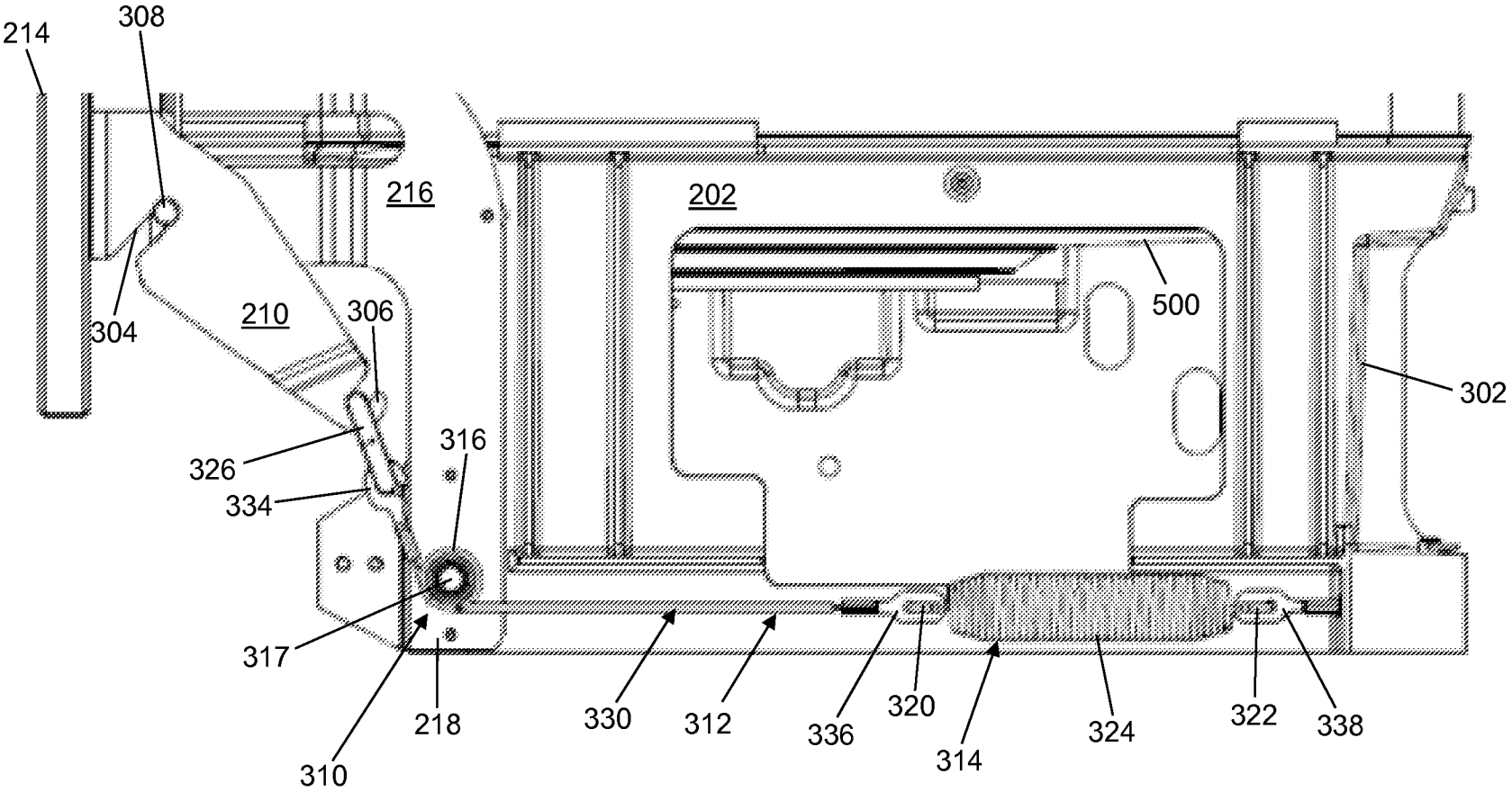
FIG. 5 depicts a right side view of the appliance of FIG. 1 zoomed to show the base portion in accordance with an illustrative embodiment.

The plurality of walls of body 106 may include a top wall 200 (shown with reference to FIG. 2), a right side wall 202 (shown with reference to FIG. 2), a left side wall 400 (shown with reference to FIG. 4), a bottom wall 204 (shown with reference to FIG. 2), a back wall 300 (shown with reference to FIG. 3), and a tub bottom wall 500 (shown with reference to FIG. 5). Top wall 200, right side wall 202, left side wall 400, back wall 300, and tub bottom wall 500 define a wash tub. Door 102 rotates downward to provide access to the wash tub (not shown) or other enclosed space of appliance 100.

A base 206 may provide a support platform for door 102 and the wash tub, as well as any other components of appliance 100. Base 206 further may define a space below the wash tub (or enclosed space) within which various components may be mounted such as the components of a door balancing system 900 (shown with reference to FIG. 9). Base 206 may include a base front wall 902 (shown with reference to FIG. 9), bottom wall 204, a base right side wall 208 (shown with reference to FIG. 2), a base left side wall 402 (shown with reference to FIG. 4), and a base back wall 302 (shown with reference to FIG. 3). Base front wall 902, base right side wall 208, base left side wall 402, and base back wall 302 are mounted to extend up from bottom wall 204 and to extend down from tub bottom wall 500.

Base front wall 902, base right side wall 208, base left side wall 402, and/or base back wall 302 may include one or more flat portions, one or more support ribs, one or more open or partially open sections, etc. to allow air to circulate between bottom wall 204 and tub bottom wall 500 while maintaining sufficient strength and rigidity to support door 102, body 106, and the remaining components of appliance 100. The one or more support ribs may extend in a generally perpendicular direction from the flat portions of base 206. Base front wall 902 may be visible from a front of appliance 100. As a result, base front wall 902 may have a cover plate 108 (shown with reference to FIG. 1) mounted to cover the visible portion of base front wall 902.

Door 102 may include a decorative panel as understood by a person of skill in the art. For example, with reference to FIG. 2, door 102 includes a structural door panel 212 and a decorative door panel 214 that mounts to structural door panel 212. In the illustrative embodiment, a right hinge 210 and a left hinge 406 (shown with reference to FIG. 4) mount proximate the lower edges of structural door panel 212, and decorative door panel 214 extends lower than right hinge 210 and left hinge 406 to hide right hinge 210 and left hinge 406 from view from a front of appliance 100. Structural door panel 212 is configured to seal the enclosed space, such as the wash tub, for performance of the operations of appliance 100 as understood by a person of skill in the art.

With reference to FIGS. 2, 3*a*, 4*a*, 5 and 6, a collar 216 may extend between a first end 218 (shown with reference to FIG. 2) positioned on a front, right edge of base right side wall 208 and a second end 404 (shown with reference to FIG. 4*b*) positioned on a front, left edge of base left side wall 402 such that collar 216 extends across a front edge of top wall 200.

Right hinge 210 (shown with reference to FIG. 2) pivotally mounts door 102 to body 106 on a right side of door 102 proximate a lower edge of structural door panel 212. Left hinge 406 (shown with reference to FIG. 4) pivotally mounts door 102 to body 106 on a left side of door 102 proximate the lower edge of structural door panel 212.

Figure 3A:
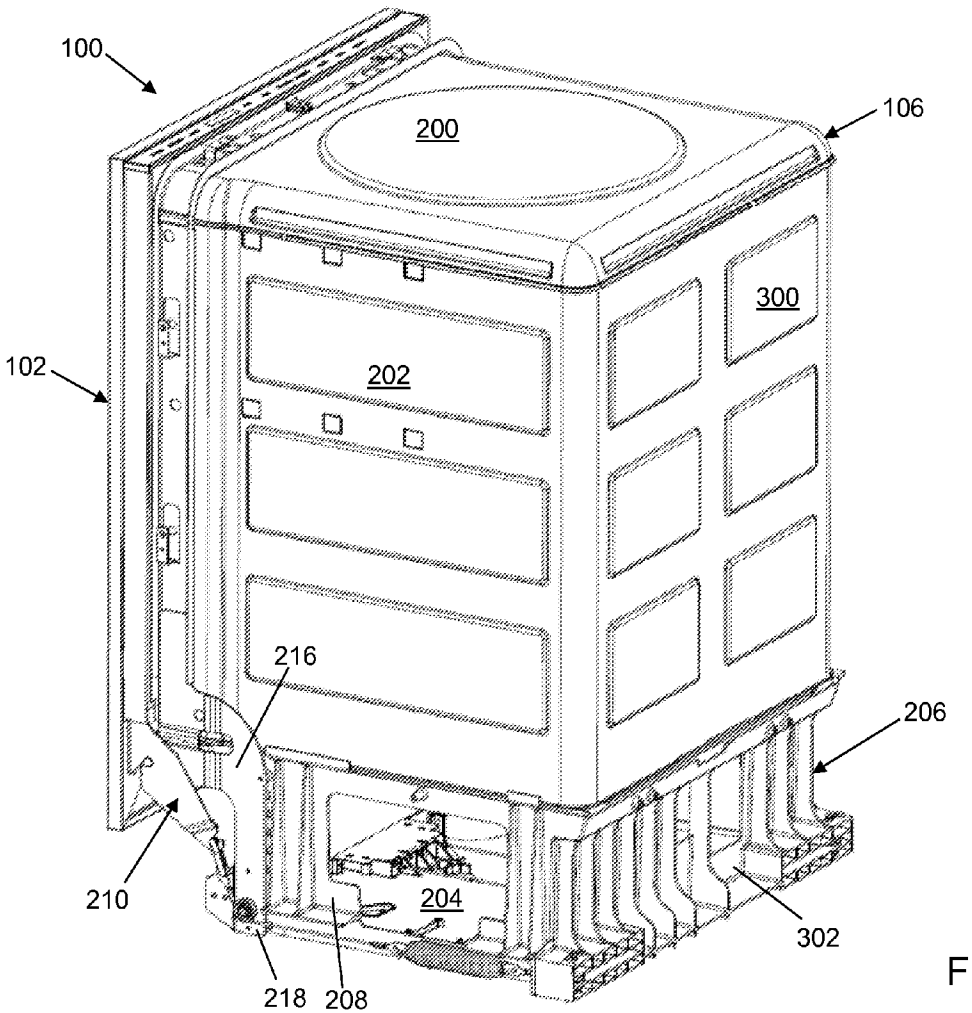
FIG. 3*a* depicts a back, right side perspective view of the appliance of FIG. 1 in accordance with an illustrative embodiment.
Figure 3B:
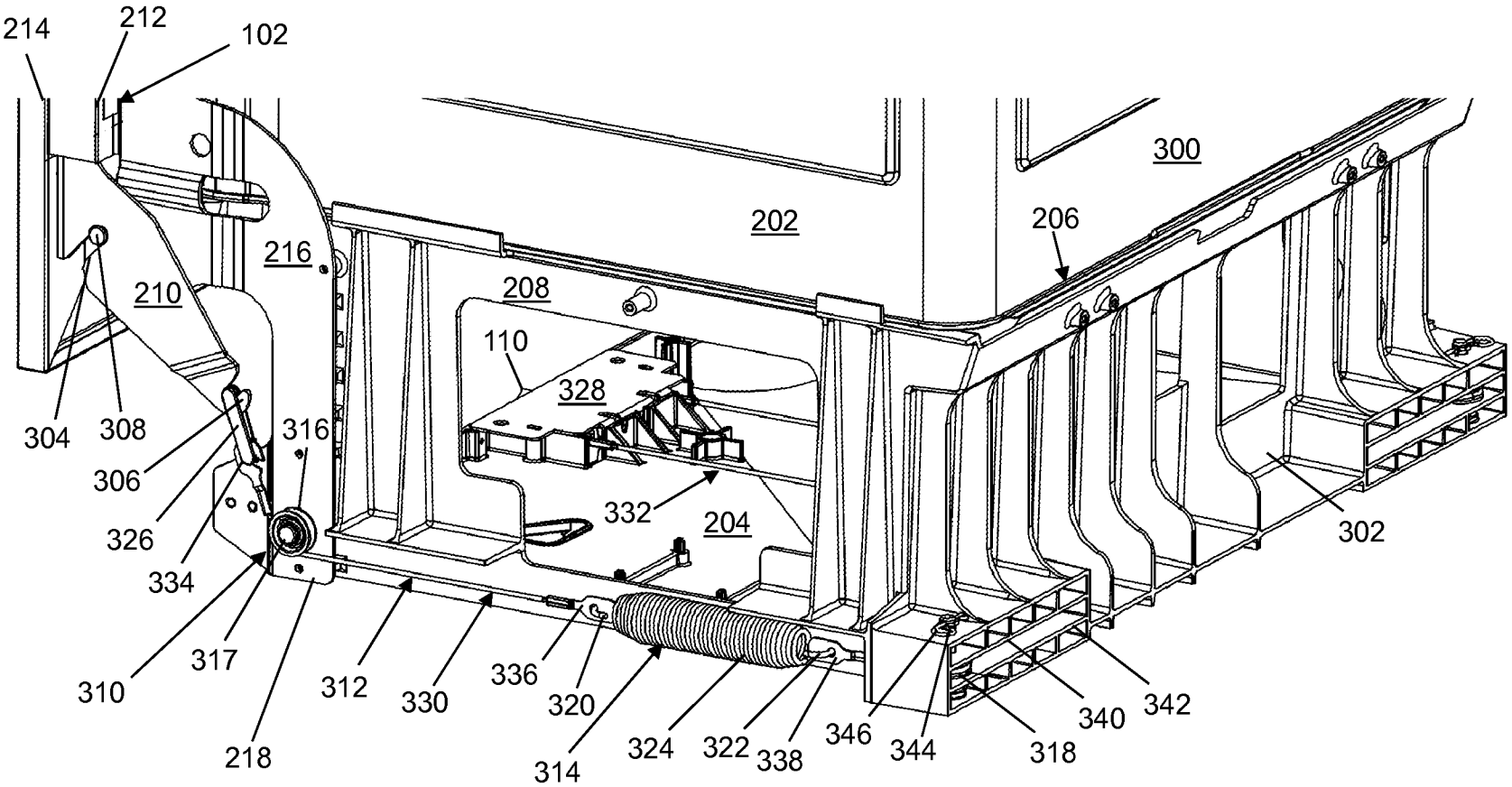
FIG. 3*b* depicts the back, right side perspective view of FIG. 3*a* zoomed to show a base portion of the appliance of FIG. 1 in accordance with an illustrative embodiment.

With reference to FIG. 3*b*, a zoomed, back, right side perspective view of base 206 is shown in accordance with an illustrative embodiment. Right hinge 210 may include an aperture 304 and a hook 306. A right hinge pin 308 protrudes from a right side of collar 216. Aperture 304 of right hinge 210 forms a slot in right hinge 210. Right hinge pin 308 is mounted within aperture 304 of right hinge 210. Door 102 rotates about right hinge pin 308 when moving from the open to the closed position or from the closed to the open position. Hook 306 of right hinge 210 extends from right hinge 210 at an end of right hinge 210 generally opposite aperture 304 of right hinge 210. Right hinge 210 may be mounted to door 102 using a variety of fasteners or using a variety of mounting methods as understood by a person of skill in the art. Illustrative fasteners include screws and rivets and illustrative mounting methods include welding.

With reference to FIG. 4*b*, a zoomed, back, left side perspective view of base 206 is shown in accordance with an illustrative embodiment. Left hinge 406 may include an aperture 408 and a hook 410. A left hinge pin 412 protrudes from a left side of collar 216. Aperture 408 of left hinge 406 forms a slot in left hinge 406. Left hinge pin 412 is mounted within aperture 408 of left hinge 406. Door 102 rotates about left hinge pin 412 when moving from the open to the closed position or from the closed to the open position. Hook 410 of left hinge 406 extends from left hinge 406 at an end of left hinge 406 generally opposite aperture 408 of left hinge 406. Left hinge 406 may be mounted to door 102 using a variety of fasteners or using a variety of mounting methods as understood by a person of skill in the art.

Figure 7:
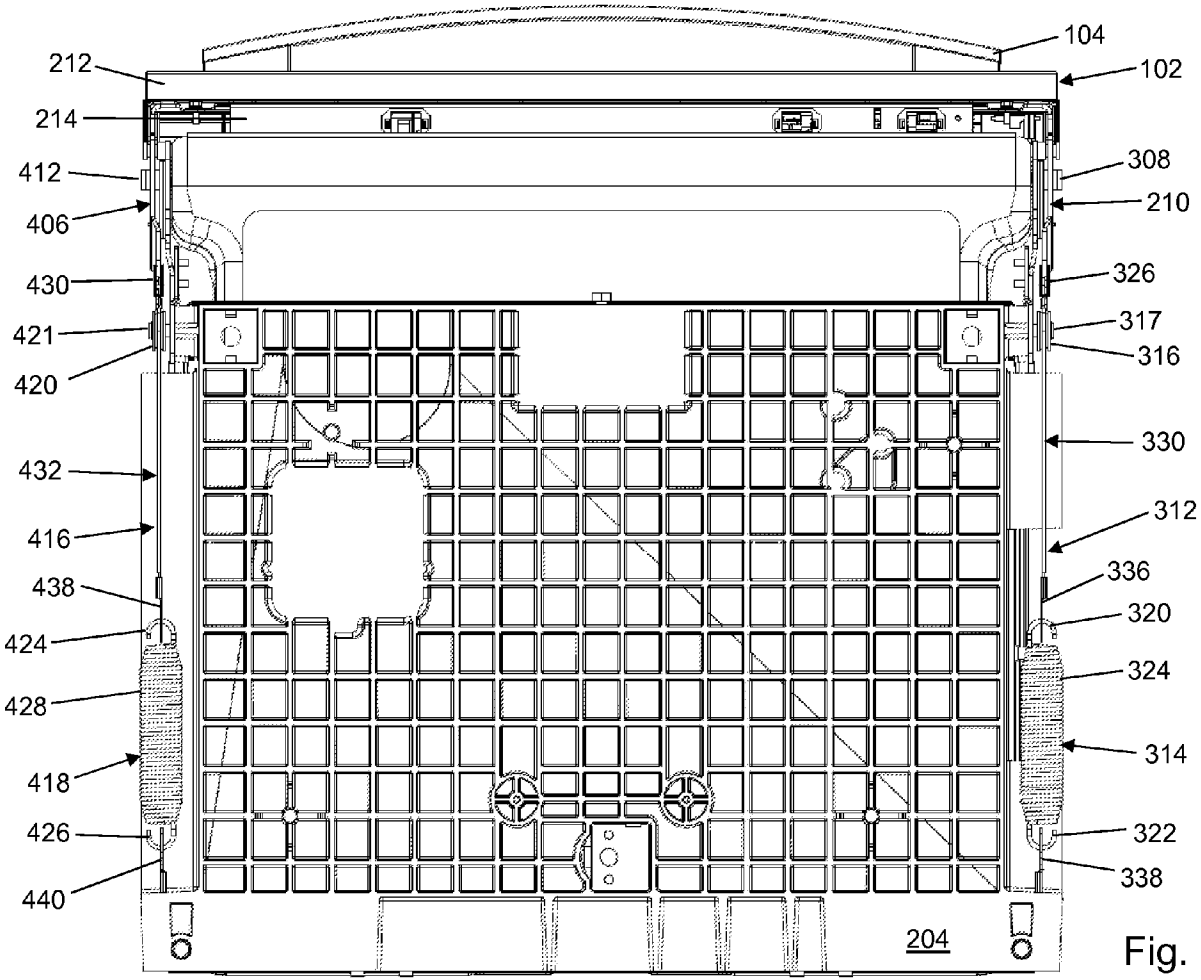
FIG. 7 depicts a bottom view of the appliance of FIG. 1 in accordance with an illustrative embodiment.

With reference to FIGS. 3*b*, 5, and 7, a right pulley system 310 of door balancing system 900 is shown in accordance with an illustrative embodiment. Right pulley system 310 may include a first cable 312, a first spring 314, a first pulley 316, a second pulley 318, and a third pulley 802 (shown with reference to FIG. 8).

In the illustrative embodiment, first spring 314 is a discrete spring having a first hook 320, a second hook 322, and a plurality of coils 324. First hook 320 extends from a first end of the plurality of coils 324. Second hook 322 extends from a second end of the plurality of coils 324 that is opposite the first end of the plurality of coils 324. In alternative embodiments, right pulley system 310 may include a plurality of springs or may include first spring 314 positioned at a different location. First spring 314 further may be formed integral with first cable 312. Thus, first cable 312 may itself have a defined elasticity and act as first spring 314.

In the illustrative embodiment, first cable 312 extends between a right connector 326 and an adjustment block 804 (shown with reference to FIG. 8) mounted within a bearing housing 328. Right connector 326 is mounted to hook 306 of right hinge 210.

In the illustrative embodiment, first cable 312 includes a first cable portion 330 and a second cable portion 332. First cable portion 330 may include a first hook 334 and a first connector 336. First hook 334 extends from a first end of first cable portion 330. First hook 334 of first cable portion 330 is mounted to right connector 326 generally opposite an end of right connector 326 that is mounted to hook 306 of right hinge 210. First connector 336 extends from a second end of first cable portion 330. First hook 320 of first spring 314 is mounted through an aperture of first connector 336 though other fasteners or mounting methods may be used as understood by a person of skill in the art.

Figure 8:
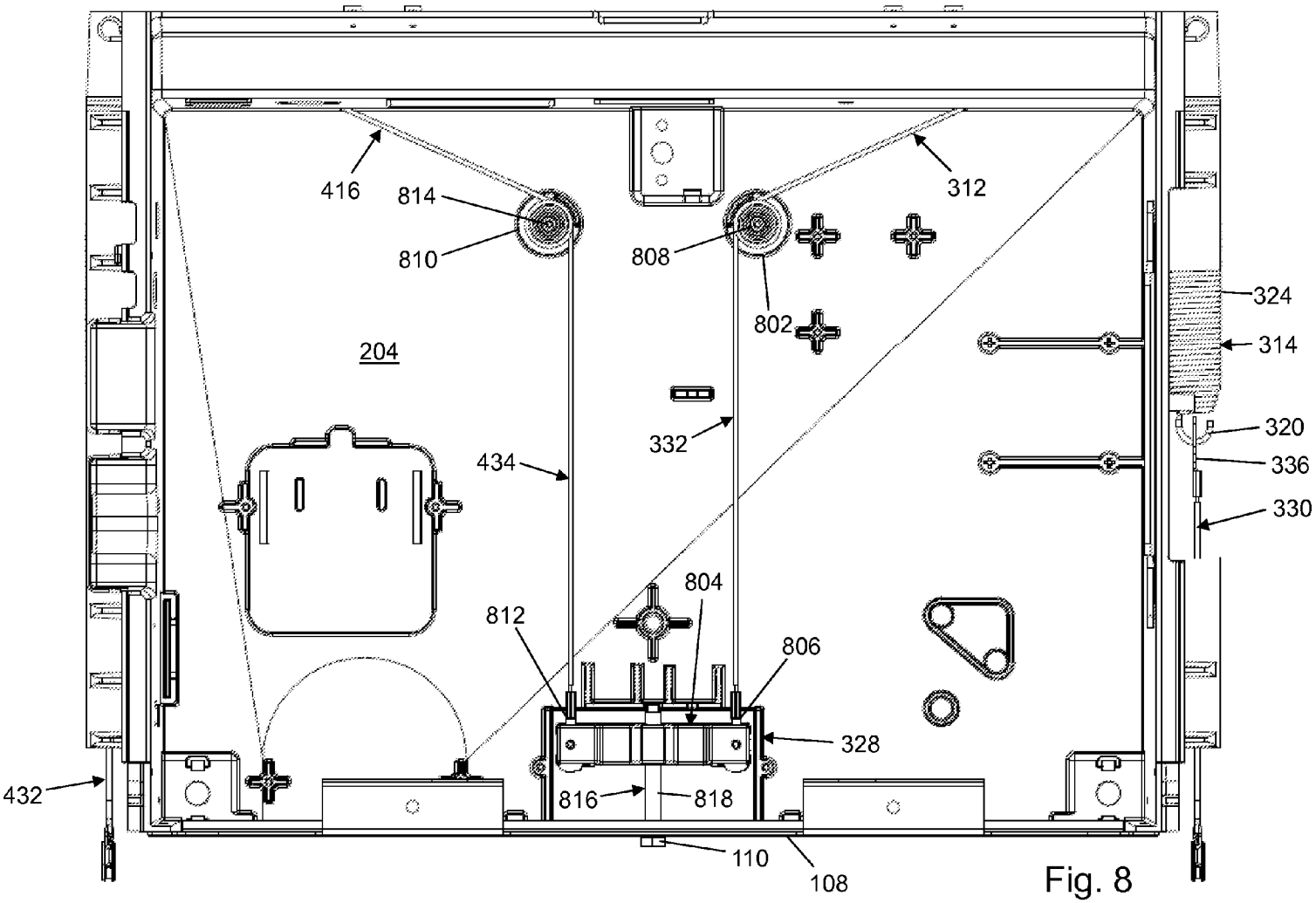
FIG. 8 depicts a top view of the base portion of the appliance of FIG. 1 in accordance with an illustrative embodiment.

Second cable portion 332 may include a second connector 338 and a third connector 806 (shown with reference to FIG. 8). Second connector 338 extends from a first end of second cable portion 332. Second hook 322 of first spring 314 is mounted through an aperture of second connector 338 though other fasteners or mounting methods may be used as understood by a person of skill in the art. Third connector 806 of second cable portion 332 is mounted to adjustment block 804 for example using a rivet though other fasteners or mounting methods may be used as understood by a person of skill in the art.

First cable portion 330 extends partially around first pulley 316 of right pulley system 310 and provides a transition from a generally vertical direction from right hinge 210 to a horizontal direction that extends generally perpendicularly from base front wall 902 of base 106. Second cable portion 332 extends partially around second pulley 318, as more clearly shown with reference to FIG. 9, and provides a transition from the generally horizontal direction that extends generally perpendicularly from base front wall 902 of base 106 to a direction towards a location of third pulley 802. Second cable portion 332 extends partially around third pulley 802, as more clearly shown with reference to FIGS. 8 and 9, and provides a transition from the direction extending between second pulley 318 and third pulley 802 to the generally horizontal direction that extends generally perpendicularly from base front wall 902 of base 106 toward the location of third pulley 802.

In the illustrative embodiment, first pulley 316 is mounted to collar 216 adjacent first end 218 of collar 216 and provides rotation about a pin 317 in a direction that is parallel to the direction of rotation of door 102 about right hinge pin 308. Second pulley 318 is mounted between a top brace wall 340 and a bottom brace wall 342. Top brace wall 340 and bottom brace wall 342 are mounted to base back wall 302 and/or bottom wall 204. A pin 344 may be inserted through an aperture defined in a center of second pulley 318. Pin 344 may be held in place by a clevis pin 346 inserted through an aperture in pin 344. Of course, other fasteners or mounting methods may be used to mount second pulley 318 to base 206 as understood by a person of skill in the art. Second pulley 318 provides rotation in the vertical direction about pin 344. Third pulley 802 is mounted to bottom wall 204 and provides rotation in the vertical direction about a pin 808 (shown with reference to FIG. 8).

Figure 6:
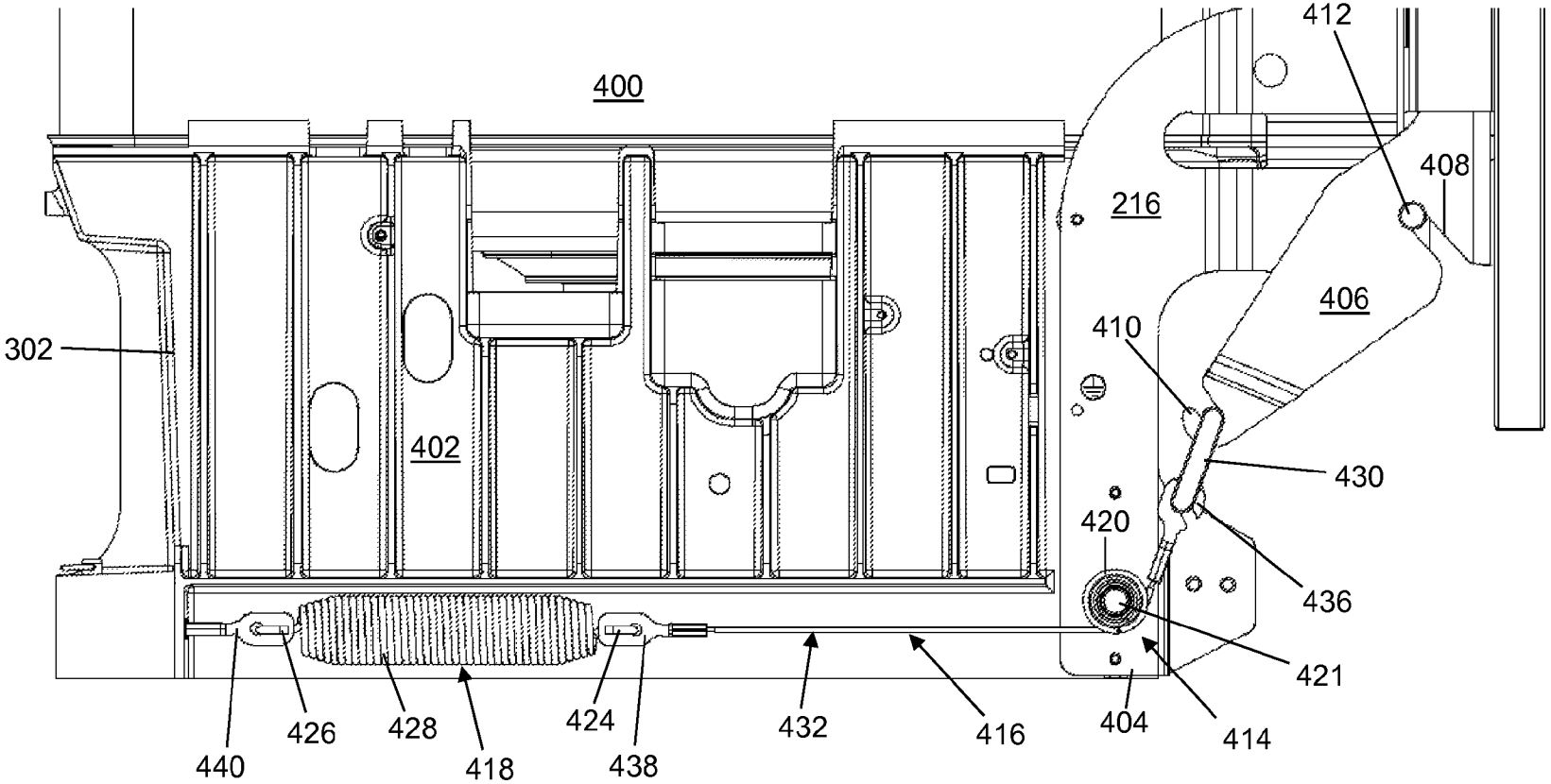
FIG. 6 depicts a left side view of the appliance of FIG. 1 zoomed to show the base portion in accordance with an illustrative embodiment.

With reference to FIGS. 4*b*, 6, and 7, a left pulley system 414 of door balancing system 900 is shown in accordance with an illustrative embodiment. Left pulley system 414 may include a second cable 416, a second spring 418, a fourth pulley 420, a fifth pulley 422, and a sixth pulley 810 (shown with reference to FIG. 8).

In the illustrative embodiment, second spring 418 is a discrete spring having a first hook 424, a second hook 426, and a plurality of coils 428. First hook 424 extends from a first end of the plurality of coils 428. Second hook 426 extends from a second end of the plurality of coils 428 that is opposite the first end of the plurality of coils 428. In alternative embodiments, left pulley system 414 may include a plurality of springs or may include second spring 418 positioned at a different location. Second spring 418 further may be formed integral with second cable 416.

In the illustrative embodiment, second cable 416 extends between a left connector 430 and adjustment block 804 mounted within bearing housing 328. Second cable 416 includes a first cable portion 432 and a second cable portion 434. First cable portion 432 may include a first hook 436 and a first connector 438. First hook 436 extends from a first end of first cable portion 432. First hook 436 of first cable portion 432 is mounted to left connector 430 generally opposite an end of left connector 430 that is mounted to hook 410 of left hinge 406. First connector 438 extends from a second end of first cable portion 432. First hook 424 of second spring 418 is mounted through an aperture of first connector 438 though other fasteners or mounting methods may be used as understood by a person of skill in the art.

Second cable portion 434 may include a second connector 440 and a third connector 812 (shown with reference to FIG. 8). Second connector 440 extends from a first end of second cable portion 434. Second hook 426 of second spring 418 is mounted through an aperture of second connector 440 though other fasteners or mounting methods may be used as understood by a person of skill in the art. Third connector 812 of second cable portion 434 is mounted to adjustment block 804 for example using a rivet though other fasteners or mounting methods may be used as understood by a person of skill in the art.

First cable portion 432 extends partially around fourth pulley 420 of left pulley system 414 and provides a transition from a generally vertical direction from left hinge 406 to a horizontal direction that extends generally perpendicularly from base front wall 902 of base 106. Second cable portion 434 extends partially around fifth pulley 422, as more clearly shown with reference to FIG. 9, and provides a transition from the generally horizontal direction that extends generally perpendicularly from base front wall 902 of base 106 to a direction towards a location of sixth pulley 810. Second cable portion 434 extends partially around sixth pulley 810, as more clearly shown with reference to FIGS. 8 and 9, and provides a transition from the direction extending between fifth pulley 422 and sixth pulley 810 to the generally horizontal direction that extends generally perpendicularly from base front wall 902 of base 106 toward the location of sixth pulley 810.

In the illustrative embodiment, fourth pulley 420 is mounted to collar 216 adjacent second end 404 of collar 216 and provides rotation about a pin 421 in a direction that is parallel to the direction of rotation of door 102 about left hinge pin 412. Fifth pulley 422 is mounted between a top brace wall 442 and a bottom brace wall 444. Top brace wall 442 and bottom brace wall 444 are mounted to base back wall 302 and/or bottom wall 204. A pin 446 may be inserted through an aperture defined in a center of fifth pulley 422. Pin 446 may be held in place by a clevis pin 448 inserted through an aperture in pin 446. Of course, other fasteners or mounting methods may be used to mount fifth pulley 422 to base 206 as understood by a person of skill in the art. Fifth pulley 422 provides rotation in the vertical direction about pin 446. Sixth pulley 810 is mounted to bottom wall 204 and provides rotation in the vertical direction about a pin 814 (shown with reference to FIG. 8).

Figure 9:
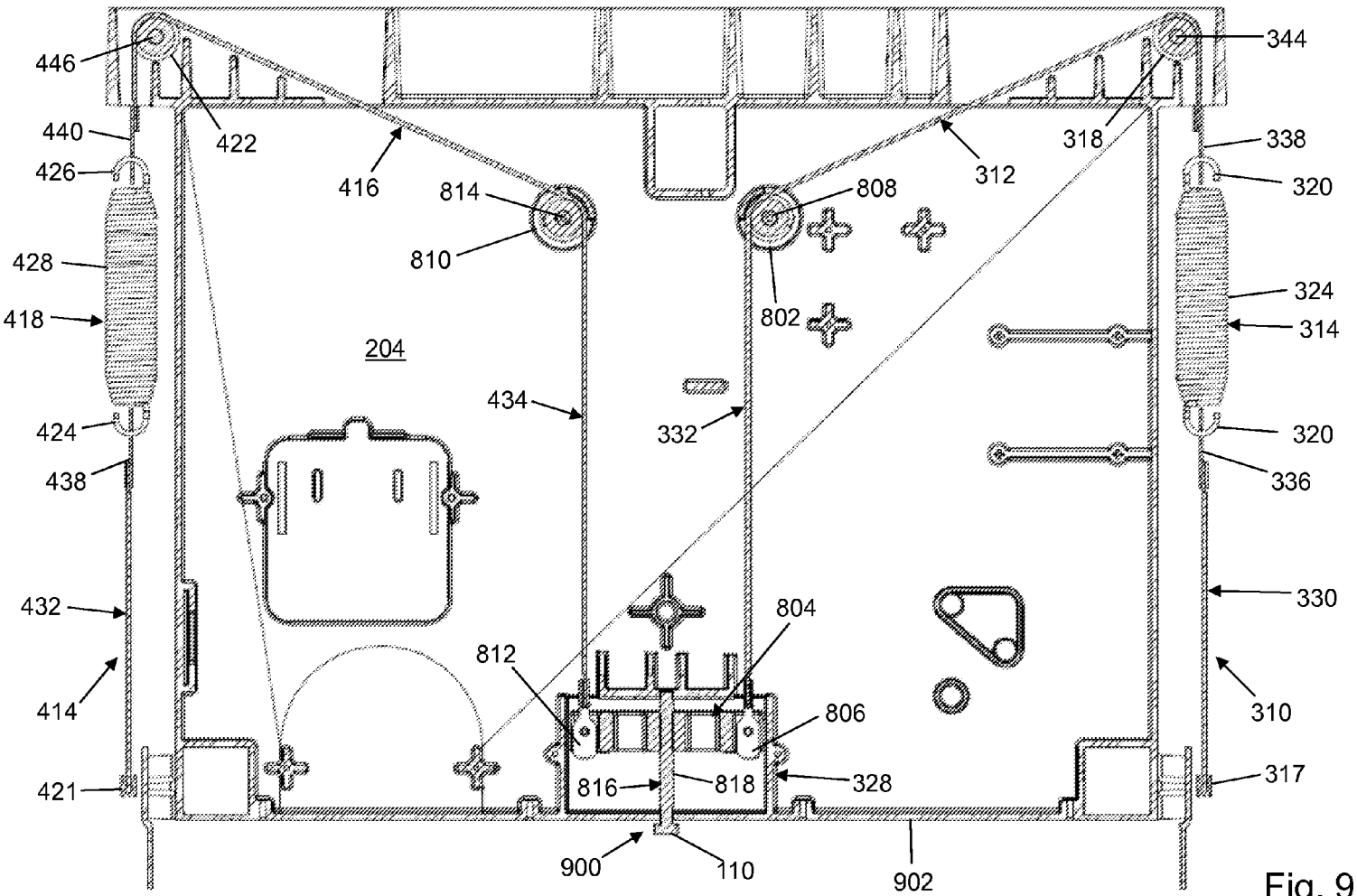
FIG. 9 depicts a top cross sectional view of the base portion of the appliance of FIG. 1 in accordance with an illustrative embodiment.

With reference to FIG. 8, an adjustment screw 816 is shown in accordance with an illustrative embodiment. Adjustment screw 816 may include a head 110 and a shaft 818. In an illustrative embodiment, head 110 of adjustment screw 816 is approximately centered between right hinge 210 and left hinge 406. Head 110 is accessible from a front of appliance 100. In an illustrative embodiment, at least a portion of shaft 818 includes a threaded surface. With reference to FIG. 9, door balancing system 900 is shown in accordance with an illustrative embodiment. Door balancing system 900 may include right pulley system 310, left pulley system 414, bearing housing 328, adjustment block 804, and adjustment screw 816.

Figure 10A:
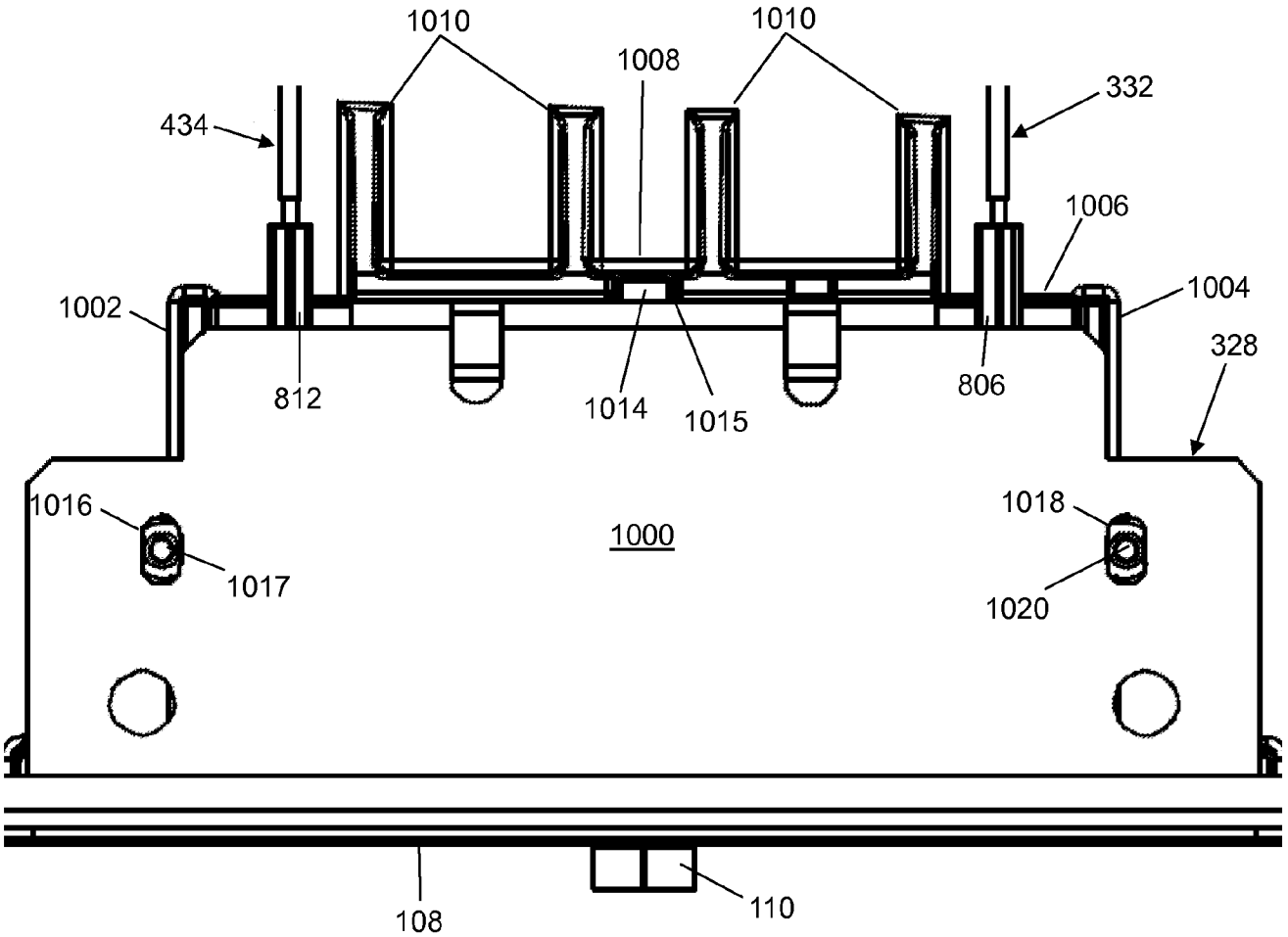
FIG. 10*a* depicts a top view of a bearing housing of the appliance of FIG. 1 in accordance with an illustrative embodiment.
Figure 10B:
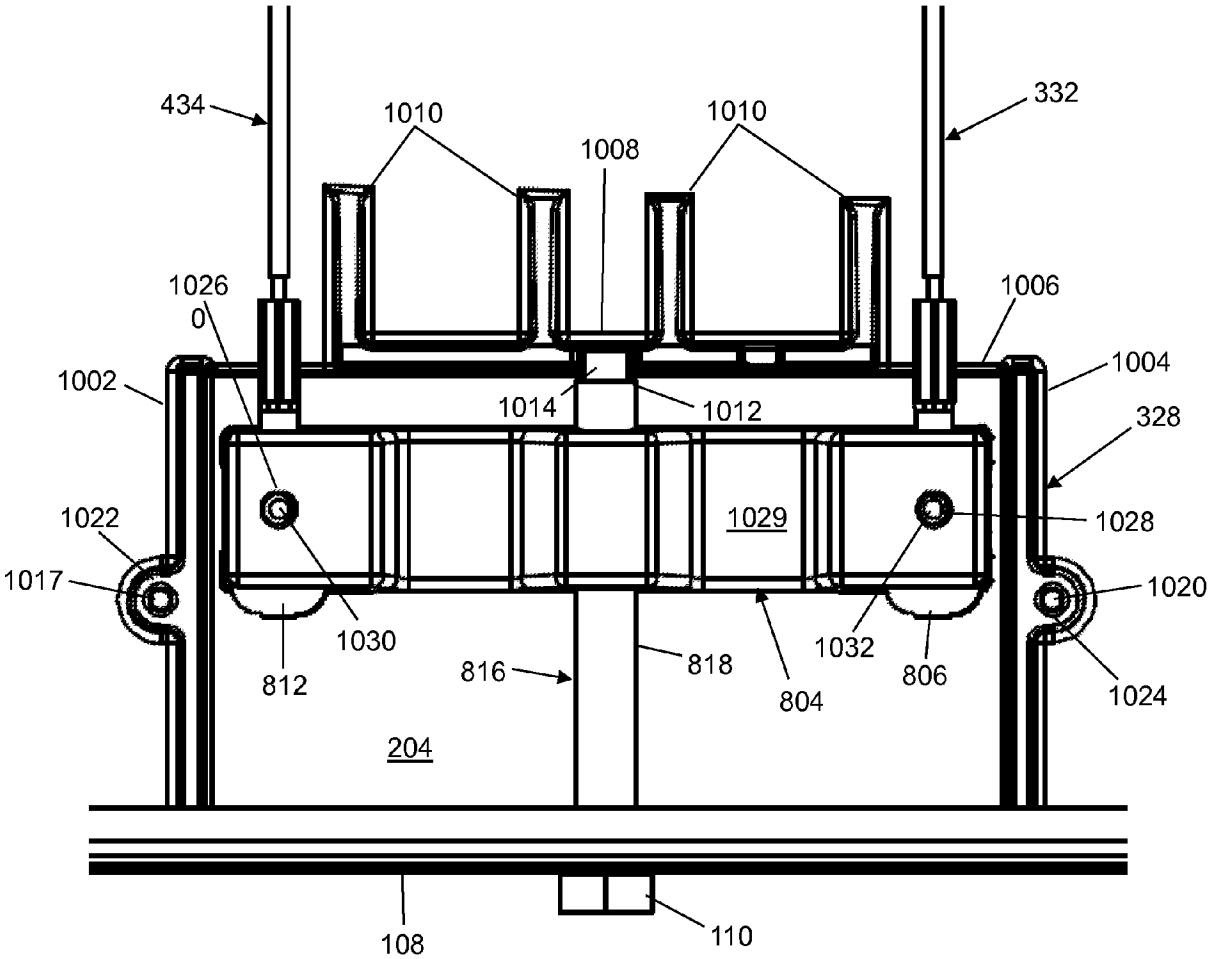
FIG. 10*b* depicts a top view of the bearing housing of FIG. 10*a* with a cover plate removed in accordance with an illustrative embodiment.
Figure 10C:
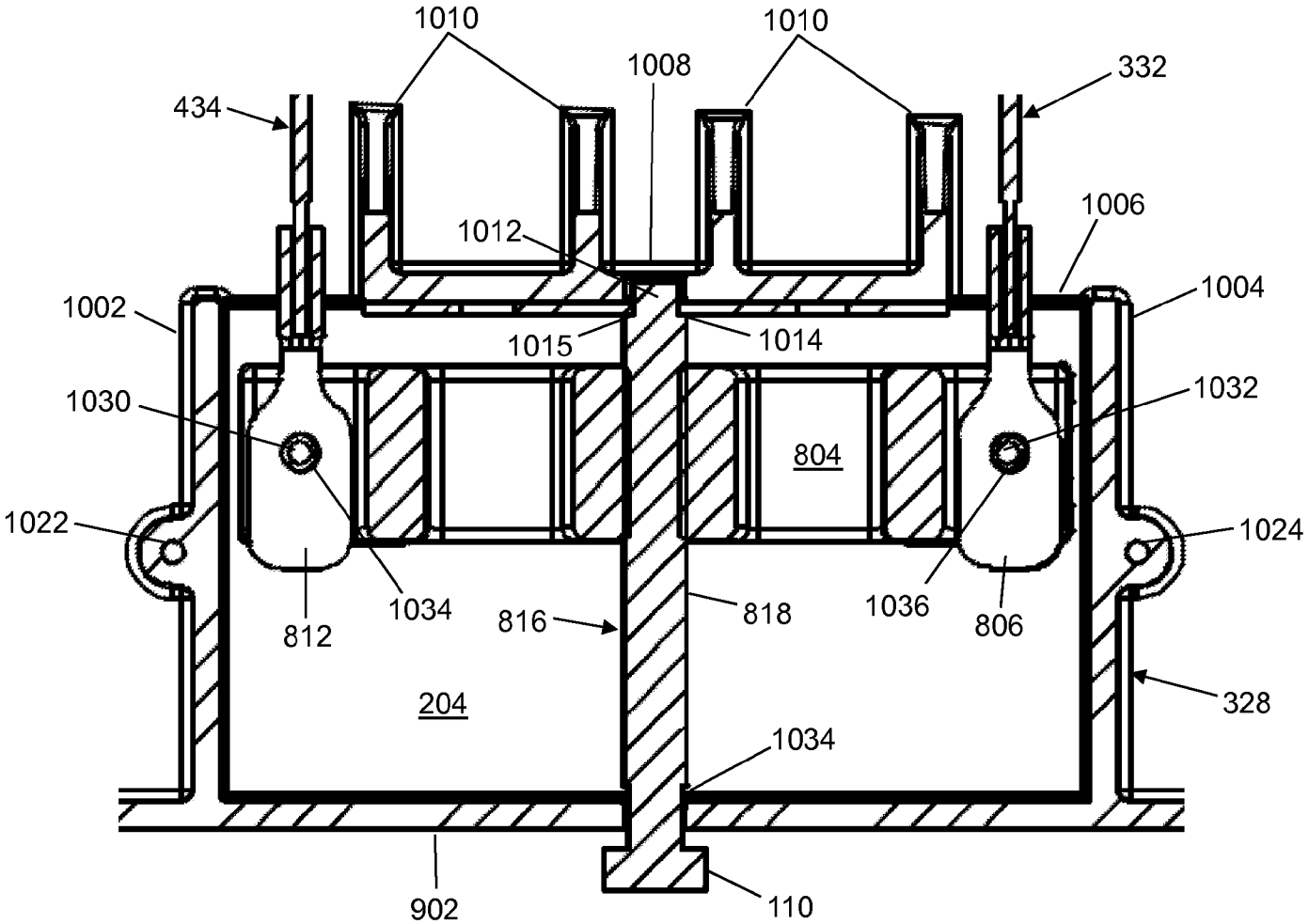
FIG. 10*c* depicts a top, cross sectional view of the bearing housing of FIG. 10*a* in accordance with an illustrative embodiment.

With reference to FIG. 10*a*, a top view of bearing housing 328 is shown in accordance with an illustrative embodiment. With reference to FIG. 10*b*, a top view of bearing housing 328 without a top wall 1000 is shown in accordance with an illustrative embodiment. With reference to FIG. 10*c*, a top, cross-sectional view of bearing housing 328 is shown in accordance with an illustrative embodiment.

Bearing housing 328 may include a plurality of walls mounted to bottom wall 204 and/or base front wall 902. Bearing housing 328 may be mounted to other walls of body 106 or base 206 of appliance 100. For example, bearing housing 328 may be mounted to tub bottom wall 500. In the illustrative embodiment, bearing housing 328 includes top wall 1000, a left side wall 1002, a right side wall 1004, and a back wall 1006. A portion of bottom wall 204 and a portion of base front wall 902 form additional walls of bearing housing 328 as shown with reference to FIG. 10*b*.

Figure 10D:
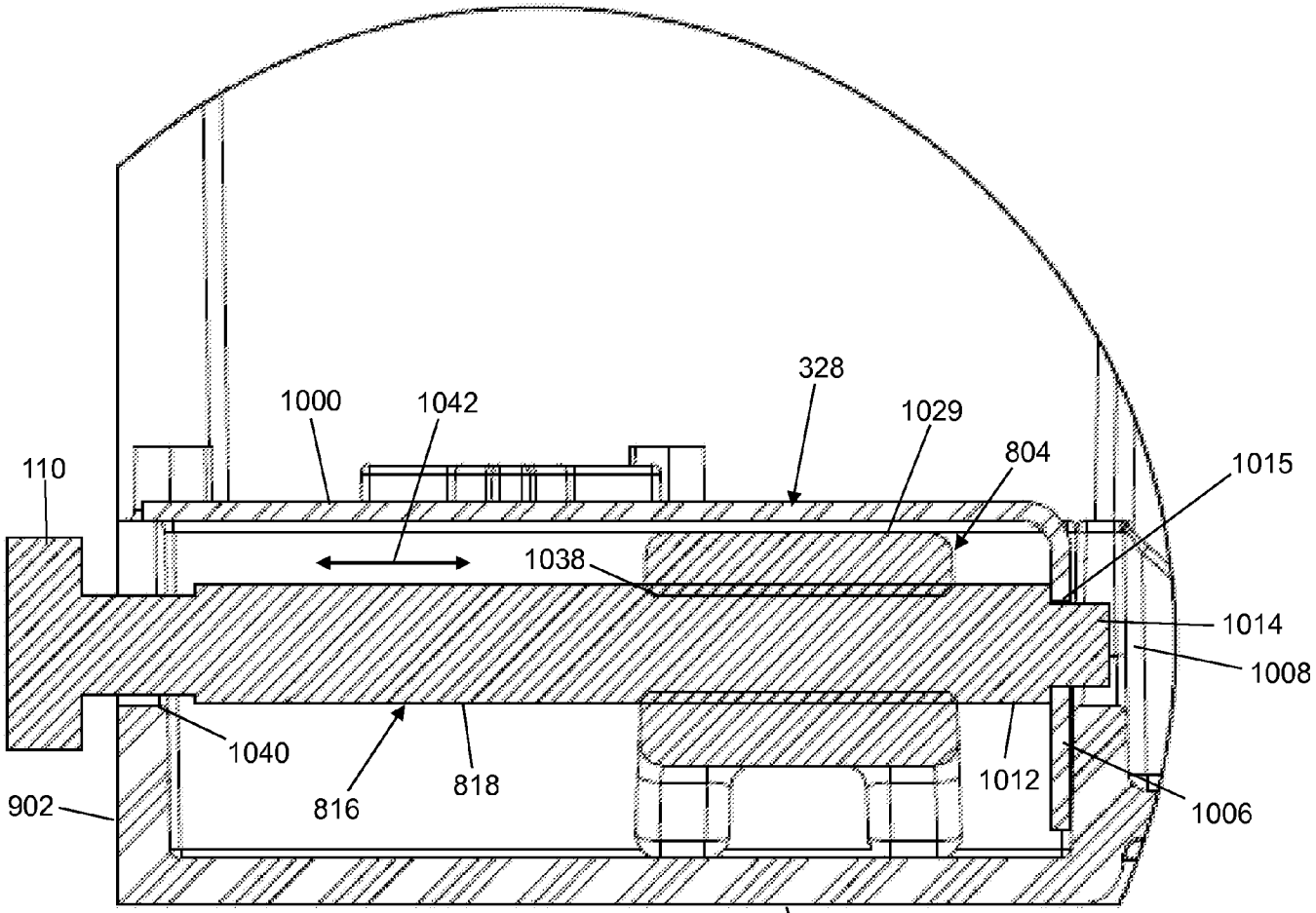
FIG. 10*d* depicts a right side, cross sectional view of the bearing housing of FIG. 10*a* in accordance with an illustrative embodiment.

As shown with reference to FIGS. 10*b*-10*d*, shaft 818 includes a first shaft portion 1012 and a second shaft portion 1014. Second shaft portion 1014 forms an end of shaft 818 opposite head 110 and has a smaller circumference than the circumference of first shaft portion 1012. Head 110 has a larger circumference than the circumference of first shaft portion 1012. First shaft portion 1012 extends between second shaft portion 1014 and head 110. Head 110 and shaft 818 may be integrally formed together of one piece of material. For example, head 110 and shaft 818 may form a screw with head 110 forming a screw head that can be rotated with a screwdriver selected based on the type of screw head. Head 110 further may be a nut that can be rotated using a socket wrench though other methods may be used to rotate shaft 818. As another alternative, head 110 may be threaded onto shaft 818 or otherwise mounted to shaft 818.

Back wall 1006 forms a bearing surface against which a portion of first shaft portion 1012 abuts. A reinforced back wall portion 1008 is positioned adjacent a portion of back wall 1006. A plurality of support ribs 1010 extend generally perpendicularly from reinforced back wall portion 1008 to provide still additional support against shaft 818. Second shaft portion 1014 fits within a wall aperture 1015 formed through back wall 1006 and through reinforced back wall portion 1008.

A first aperture 1016 and a second aperture 1018 are formed in top wall 1000 of bearing housing 328. A third aperture 1022 and a fourth aperture 1024 are formed in left side wall 1002 and right side wall 1004, respectively, of bearing housing 328. A first fastener 1017 may be inserted into first aperture 1016 and third aperture 1022 to mount top wall 1000 to left side wall 1002. A second fastener 1020 may be inserted into second aperture 1018 and fourth aperture 1024 to mount top wall 1000 to right side wall 1004. In an illustrative embodiment, first fastener 1017 and second fastener 1020 are screws though other fasteners or mounting methods may be used as understood by a person of skill in the art to mount top wall 1000 to the other walls of bearing housing 328 and/or to bottom wall 204 or base front wall 902.

A fifth aperture 1026 and a sixth aperture 1028 are formed in a top surface 1029 of adjustment block 804. A seventh aperture 1034 and an eighth aperture 1036 are formed in third connector 812 of second cable portion 434 of second cable 416 and third connector 806 of second cable portion 332 of first cable 312, respectively. A third fastener 1030 may be inserted into fifth aperture 1026 and seventh aperture 1034 to mount second cable 416 to adjustment block 804. A fourth fastener 1032 may be inserted into sixth aperture 1028 and eighth aperture 1036 to mount first cable 312 to adjustment block 804. In an illustrative embodiment, third fastener 1030 and fourth fastener 1032 are split pins though other fasteners or mounting methods may be used as understood by a person of skill in the art to mount first cable 312 and second cable 416 to adjustment block 804.

With reference to FIG. 10*d*, adjustment block 804 includes a threaded orifice 1038. Threaded orifice 1038 is sized and shaped to accept shaft 818. Second shaft portion 1014 of shaft 818 is inserted through a front aperture 1040 formed in base front wall 902 until an edge between first shaft portion 1012 and second shaft portion 1014 abuts back wall 1006 of bearing housing 328. Front aperture 1040 is sized and shaped to accept shaft 818, but not head 110 so that head 110 remains exterior to appliance 100. First shaft portion 1012 extends at least partially through threaded orifice 1038 of adjustment block 804. Rotation of head 110 causes adjustment block 804 to translate within the walls of bearing housing 328 in a direction 1042 that is generally perpendicular to base front wall 902. Thus, a position of adjustment block 804 can be adjusted from exterior of appliance 100 using adjustment screw 816.

In an alternative embodiment, rotation of head 110 may result in rotation of adjustment block 804 within the bearing housing. For example, a gearing mechanism may be used to convert rotation of head 110 to rotation of adjustment block 804 about an axis that is perpendicular to an axis of rotation of shaft 818. Rotation of adjustment block 804 causes first cable 312 and second cable 416 to wrap around or unwrap from adjustment block 804 thereby adjusting the force exerted by first spring 314 and second spring 418 simultaneously.

The stored force exerted by first spring 314 and second spring 418 through right pulley system 310 and left pulley system 414 assists in closing door 102 and in opening door 102 without bouncing against stops. Thus, first spring 314 and second spring 418 control a rate of movement of door 102 relative to body 106. Changing the position of adjustment block 804 adjusts the tension exerted by first spring 314 and second spring 418 simultaneously. The amount of the stored force can be increased by turning head 100 in a direction that increases the distance between adjustment block 804 and back wall 1006 of bearing housing 328. The amount of the stored force can be decreased by turning head 100 in the opposite direction to decrease the distance between adjustment block 804 and back wall 1006 of bearing housing 328. Thus, the force exerted on door 102 can be controlled using a single adjustment screw 816, which is accessible from the exterior of appliance 100. As understood by a person of skill in the art, the specific characteristics of door balancing system 900 are determined based on the range of torque needed to appropriately control the opening/closing of door 102 based on the dimensions, weight, and weight distribution of door 102.

Right pulley system 310 and left pulley system 414 form elastic systems that counteract the force of gravity exerted on door 102 as the door moves between a vertical position and a horizontal position. The design of the pulley system effects how the tension force exerted by first spring 314 and second spring 418 changes relative to the translational movement of adjustment block 804. As shown with reference to FIGS. 11*a*-11*f*, various pulley arrangements may be used for right pulley system 310 and left pulley system 414. FIG. 11*a* illustrates a first pulley system 1100 similar to that described above for door balancing system 900 except that first pulley 316 and fourth pulley 420 are not used. Instead, first cable 312 mounts directly to right hinge 210, and second cable 416 mounts directly to left hinge 406.

Figure 11B:
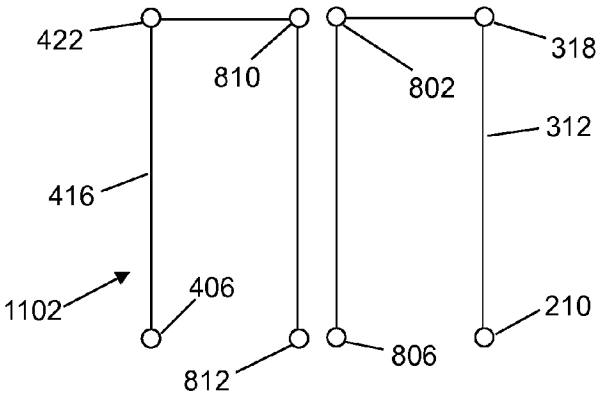
FIGS. 11*a*-11*f* depict alternative pulley system arrangements for the appliance of FIG. 1 in accordance with additional illustrative embodiments.
Figure 11A:
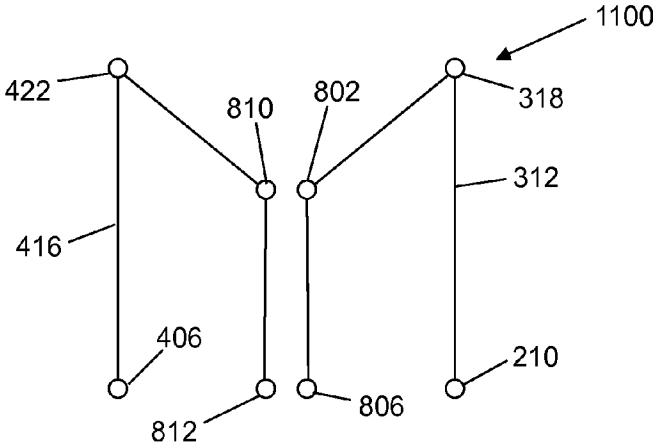
Figure 11C:
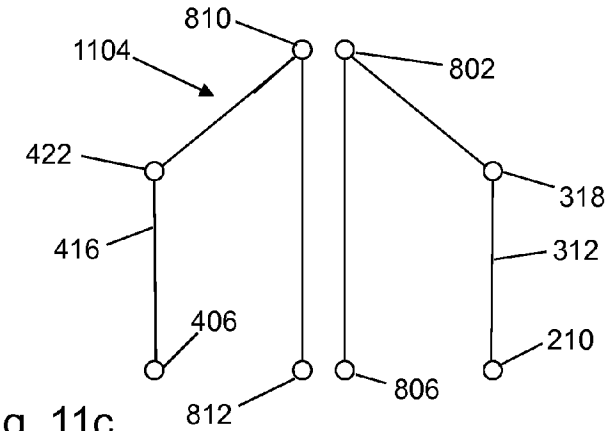

FIG. 11*b* illustrates a second pulley system 1102 similar to that shown with reference to FIG. 11*a* except that third pulley 802 is positioned such that first cable 312 extends generally perpendicularly from second pulley 318, and sixth pulley 810 is positioned such that second cable 416 extends generally perpendicularly from fifth pulley 422. FIG. 11 *c* illustrates a third pulley system 1104 similar to that shown with reference to FIG. 11*b* except that third pulley 802 is positioned such that first cable 312 extends at an angle of greater than 90 degrees from second pulley 318, and sixth pulley 810 is positioned such that second cable 416 extends at an angle of greater than 90 degrees from fifth pulley 422.

Figure 11D:
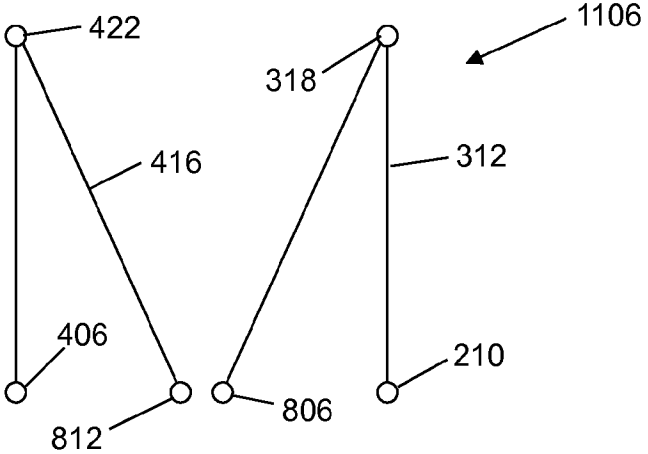

FIG. 11*d* illustrates a fourth pulley system 1106 that does not include third pulley 802 or sixth pulley 810. Instead, first cable 312 extends directly from second pulley 318 to third connector 806 of second cable portion 332 of first cable 312 mounted to adjustment block 804. Second cable 416 extends directly from fifth pulley 422 to third connector 812 of second cable portion 434 of second cable 416 mounted to adjustment block 804.

Figure 11E:
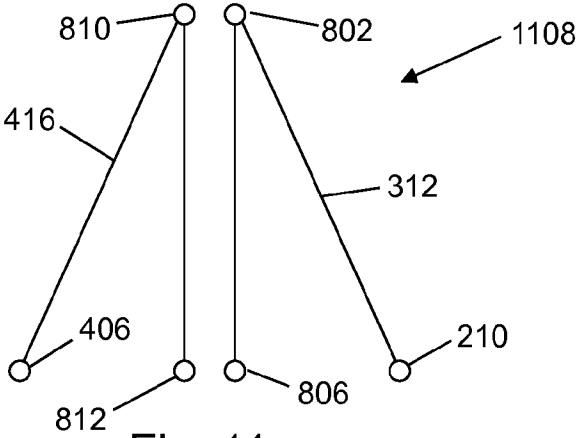

FIG. 11*e* illustrates a fifth pulley system 1108 similar to that shown with reference to FIG. 11*d* except that fifth pulley system 1108 includes third pulley 802 or sixth pulley 810, but does not include second pulley 318 or fifth pulley 422. Instead, first cable 312 extends directly from right hinge 210 to third pulley 802. Second cable 416 extends directly from left hinge 406 to sixth pulley 810.

Figure 11F:
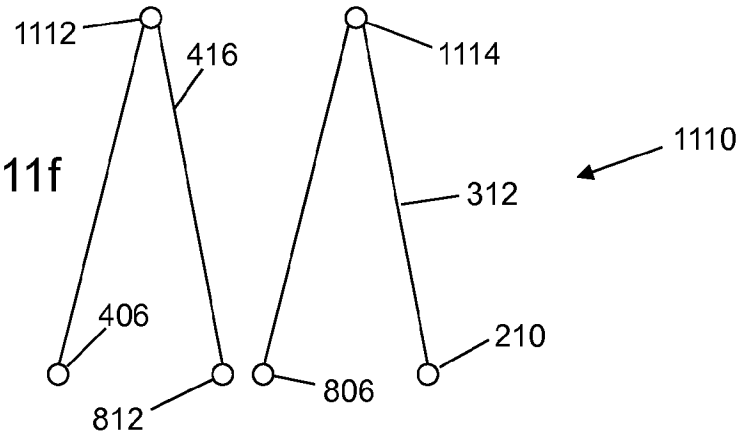

FIG. 11*f* illustrates a sixth pulley system 1110 similar to that shown with reference to FIG. 11*e* except that sixth pulley system 1110 includes a seventh pulley 1112 and an eighth pulley 1114 and does not include second pulley 318, third pulley 802, fifth pulley 422, or sixth pulley 810. First cable 312 extends directly from right hinge 210 to eighth pulley 1114 and from eighth pulley 1114 to third connector 806 of second cable portion 332 of first cable 312 mounted to adjustment block 804. Second cable 416 extends directly from left hinge 406 to seventh pulley 1112 and from seventh pulley 1112 to third connector 812 of second cable portion 434 of second cable 416 mounted to adjustment block 804.

It should be understood that various combinations and permutations of pulley systems may be used. Additionally, it should be understood that one or more springs may be positioned along the length of cable between each door hinge and adjustment block 804.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A door balancing system comprising:

an adjustment block configured to mount within a bearing housing, wherein the bearing housing comprises a bearing surface mounted to a body of an appliance, the adjustment block comprising a threaded orifice;

a single adjustment screw configured for threading into the threaded orifice and configured to abut the bearing surface;

a first pulley system comprising a first pulley, a first cable, and a first spring, wherein the first cable is configured to mount between a first hinge and the adjustment block using the first pulley and the first spring, wherein the first hinge is configured to mount a door to the body on a first side of the door, and further wherein the first pulley is configured to mount to the body; and a second pulley system comprising a second pulley, a second cable, and a second spring, wherein the second cable is configured to mount between a second hinge and the adjustment block using the second pulley and the second spring, wherein the second hinge is configured to mount the door to the body on a second side of the door, and further wherein the second pulley is configured to mount to the body;

wherein the first spring and the second spring are configured to exert a force on the door to control a rate of movement of the door relative to the body.

2. An appliance comprising:

a body;

a bearing housing comprising a bearing surface mounted to the body;

a door;

a first hinge pivotally mounting the door to the body on a first side of the door proximate a lower edge of the door;

a second hinge pivotally mounting the door to the body on a second side of the door proximate the lower edge of the door; and a door balancing system comprising an adjustment block mounted within the bearing housing, the adjustment block comprising a threaded orifice;

a single adjustment screw inserted into the threaded orifice to abut the bearing surface;

a first pulley system comprising a first pulley, a first cable, and a first spring, wherein the first pulley is mounted to the body, and further wherein the first cable is configured to mount between the first hinge and the adjustment block using the first pulley and the first spring; and a second pulley system comprising a second pulley, a second cable, and a second spring, wherein the second pulley is mounted to the body, and further wherein the second cable is configured to mount between the second hinge and the adjustment block using the second pulley and the second spring;

wherein the first spring and the second spring are configured to exert a force on the door to control a rate of movement of the door relative to the body.

3. The appliance of claim 2, wherein the body comprises a base that includes a plurality of walls, wherein the door is mounted above a first wall of the plurality of walls of the base, and further wherein a head of the single adjustment screw is accessible from an exterior of the first wall.

4. The appliance of claim 3, wherein the head is configured to rotate thereby causing the adjustment block to translate within the bearing housing in a direction that is perpendicular to the plane of the first wall.

5. The appliance of claim 4, wherein translation of the adjustment block adjusts the force exerted by the first spring and the second spring simultaneously.

6. The appliance of claim 3, wherein the head is configured to rotate thereby causing the adjustment block to rotate within the bearing housing, wherein rotation of the adjustment block adjusts the force exerted by the first spring and the second spring simultaneously.

7. The appliance of claim 3, wherein the head of the single adjustment screw is approximately centered between the first hinge and the second hinge.

8. The appliance of claim 2, wherein the first cable comprises a first cable portion and a second cable portion, wherein the first cable portion is mounted between the first hinge and a first end of the first spring, wherein the second cable portion is mounted between the adjustment block and a second end of the first spring, wherein the second end of the first spring is opposite the first end of the first spring.

9. The appliance of claim 8, wherein the second cable portion extends at least partially around the first pulley.

10. The appliance of claim 9, wherein the first pulley system further comprises a third pulley mounted to the body, wherein the second cable portion extends at least partially around the third pulley.

11. The appliance of claim 8, wherein the first cable portion extends at least partially around the first pulley.

12. The appliance of claim 11, wherein the first pulley system further comprises a third pulley mounted to the body, wherein the first cable portion extends at least partially around the third pulley.

13. The appliance of claim 8, wherein a first end of the first cable portion directly mounts to the first hinge and a second end of the first cable portion mounts to the first end of the first spring.

14. The appliance of claim 8, wherein a first end of the first cable portion indirectly mounts to the first hinge and a second end of the first cable portion mounts to the first end of the first spring.

15. The appliance of claim 8, wherein the first pulley system further comprises a third pulley mounted to the body, wherein the first cable portion extends at least partially around the third pulley.

16. The appliance of claim 3, wherein the first cable comprises a first cable portion and a second cable portion, wherein the first cable portion is mounted between the first hinge and a first end of the first spring, wherein the second cable portion is mounted between the adjustment block and a second end of the first spring, wherein the second end of the first spring is opposite the first end of the first spring, wherein the first pulley is mounted to the body such that the first cable portion extends from the first hinge in a first direction that is approximately perpendicular to the plane of the first wall.

17. The appliance of claim 16, wherein the first pulley system further comprises a third pulley, wherein the third pulley is mounted to the body such that the second cable portion extends at least partially around the third pulley, and, prior to extending at least partially around the third pulley, the second cable portion extends from the adjustment block in the first direction.

18. The appliance of claim 16, wherein the first pulley system further comprises a third pulley, wherein the third pulley is mounted to the body such that the first cable portion extends at least partially around the third pulley, wherein the second cable portion extends from the adjustment block in the first direction, and further wherein, prior to extending at least partially around the third pulley, the first cable portion extends from the first end of the first spring in the first direction.

19. The appliance of claim 3, wherein the first cable comprises a first cable portion and a second cable portion, wherein the first cable portion is mounted between the first hinge and a first end of the first spring, wherein the second cable portion is mounted between the adjustment block and a second end of the first spring, wherein the second end of the first spring is opposite the first end of the first spring, wherein the first pulley is mounted to the body such that the second cable portion extends from the adjustment block in a direction that is approximately perpendicular to the plane of the first wall.

20. The appliance of claim 2, wherein the first cable comprises a first cable portion, a second cable portion, and a third cable portion, wherein the first spring comprises a first spring portion and a second spring portion, wherein the first cable portion is mounted between the first hinge and a first end of the first spring portion, wherein the second cable portion is mounted between the adjustment block and a first end of the second spring portion, wherein the third cable portion is mounted between a second end of the first spring portion and a second end of the second spring portion, wherein the second end of the first spring portion is opposite the first end of the first spring portion and the second end of the second spring portion is opposite the first end of the second spring portion.

* * * * *